United States Patent [19]

Okumura et al.

[11] Patent Number: 4,784,829

[45] Date of Patent: Nov. 15, 1988

[54] CONTACT MATERIAL FOR VACUUM CIRCUIT BREAKER

[75] Inventors: Mitsuhiro Okumura; Eizo Naya, both of Amagasaki, Japan

[73] Assignee: Mitsubishi Denki Kabushiki Kaisha, Tokyo, Japan

[21] Appl. No.: 857,190

[22] Filed: Apr. 29, 1986

[30] Foreign Application Priority Data

Apr. 30, 1985 [JP] Japan ..... 60-94809
Apr. 30, 1985 [JP] Japan ..... 60-94811

[51] Int. Cl.[4] ..... C22C 9/00; C22C 27/06

[52] U.S. Cl. ..... 420/428; 420/495; 200/266

[58] Field of Search ..... 420/495, 469; 148/411, 148/432; 200/266; 75/244, 238

[56] References Cited

U.S. PATENT DOCUMENTS

| | | | |
|---|---|---|---|
| 3,054,671 | 9/1962 | London et al. | 920/469 |
| 3,240,572 | 3/1966 | Bray | 148/432 |
| 3,379,846 | 4/1968 | Wood et al. | 200/144 |
| 3,514,559 | 5/1970 | Ranherm | 200/144 |
| 3,574,609 | 4/1971 | Finlay et al. | 420/495 |
| 3,859,087 | 1/1975 | Backstrom | 75/213 |
| 4,302,514 | 11/1981 | Kato et al. | 428/569 |
| 4,365,994 | 12/1982 | Ray | 148/13 |
| 4,450,135 | 5/1984 | Peters et al. | 75/244 |
| 4,457,780 | 7/1984 | Osada et al. | 75/236 |
| 4,517,033 | 5/1985 | Okumura et al. | 148/432 |

FOREIGN PATENT DOCUMENTS

| | | | |
|---|---|---|---|
| 109088 | 5/1984 | European Pat. Off. | 420/495 |
| 2503926 | 10/1982 | Japan | 75/244 |

*Primary Examiner*—Christopher W. Brody
*Attorney, Agent, or Firm*—Oblon, Fisher, Spivak, McClelland & Maier

[57] ABSTRACT

A contact material for a vacuum circuit breaker of excellent current breaking property and voltage withstand capability can be made from an alloy composed of copper and boride of tantalum, or an alloy composed of copper, boride of tantalum and titanium, or an alloy composed of copper, chromium, and boride of tantalum.

4 Claims, 6 Drawing Sheets

CONTACT MATERIAL FOR VACUUM CIRCUIT BREAKER

BACKGROUND OF THE INVENTION

1. Field of the Invention

This invention relates to a contact material for a vacuum circuit breaker, which is excellent in large current breaking property and high voltage withstand capability.

2. Description of Prior Art

The vacuum circuit breaker has various advantages such that it is free from maintenance, does not bring about public pollution, is excellent in its current breaking property, and so forth, on account of which the extent of its application has become widened very rapidly. With this expansion in its utility, demands for higher voltage withstand property and larger current breaking capability of the vacuum circuit breaker have become increasingly high. On the other hand, the performance of the vacuum circuit breaker depends, to a large extent, on those factors to be determined by the contact material placed within a vacuum container for the vacuum circuit breaker.

For the characteristics of the contact material for the vacuum circuit breaker to satisfy, there may be enumerated: (1) large current breaking capacity; (2) high voltage withstand; (3) small contact resistance; (4) small melt-adhesion; (5) low consumption rate of the contact; (6) small breaking current; (7) good workability; (8) sufficient mechanical strength; and so on.

In the actual contact material, it is fairly difficult to satisfy all of these characteristics, and general circumstances at the present time are such that use is made of a material which meets particularly important characteristic depending on its utilization at the sacrifice of other characteristics to some extent. For instance, the contact material of copper-tungsten alloy as disclosed in Japanese Unexamined Patent Publication No. 78429/1980 is excellent in its voltage withstand capability, so it is frequently employed for a load-break switch or a contactor. However, it has a disadvantage such that its current breaking property is inferior.

On the other hand, the contact material of copper-chromium alloy as disclosed, for example, in Japanese Unexamined Patent Publication No. 71375/1979 has been widely used for a circuit breaker or the like owing to its excellent current breaking property, but its voltage withstand capability is inferior to that of the above-mentioned contact material of copper-tungsten alloy.

As described in the foregoing, the conventional contact materials for the vacuum circuit breaker have so far been used in taking advantage of various properties they possess. In recent years, however, requirements for large current breaking capability and higher voltage withstand property of the vacuum circuit breaker have become more and more stringent with the result that such conventional contact materials tend to be difficult to satisfy the required performance. There has also been a demand for the contact material having more excellent performance against size-reduction in the vacuum circuit breaker. Ideally, therefore, a contact material having more excellent current breaking property than that of the above-mentioned copper-chromium alloy contact, and more excellent voltage withstand capability than that of the copper-tungsten alloy contact is desired.

SUMMARY OF THE INVENTION

The present invention has been made with a view to eliminating various points of problem inherent in the conventional contact material as mentioned in the foregoing, and aims at providing an improved contact material for the vacuum circuit breaker excellent in its large current breaking property and higher voltage withstand capability.

According to the present invention, in one aspect of it, there is provided a contact material for the vacuum circuit breaker, which consists essentially of copper and boride of tantalum.

According to the present invention, in another aspect of it, there is provided a contact material for the vacuum circuit breaker, which consists essentially of copper, boride of tantalum, and titanium.

According to the present invention, in other aspect of it, there is provided a contact material for the vacuum circuit breaker, which consists essentially of copper, chromium, and boride of tantalum.

The foregoing object, other objects as well as constituent elements for the contact material, the manner of manufacturing the same, and the characteristics of the contact material according to the present invention will become more apparent and understandable from the following detailed description thereof, when read in conjunction with specific examples and in reference to the accompanying drawing.

BRIEF DESCRIPTION OF THE ACCOMPANYING DRAWING

Figure 6:
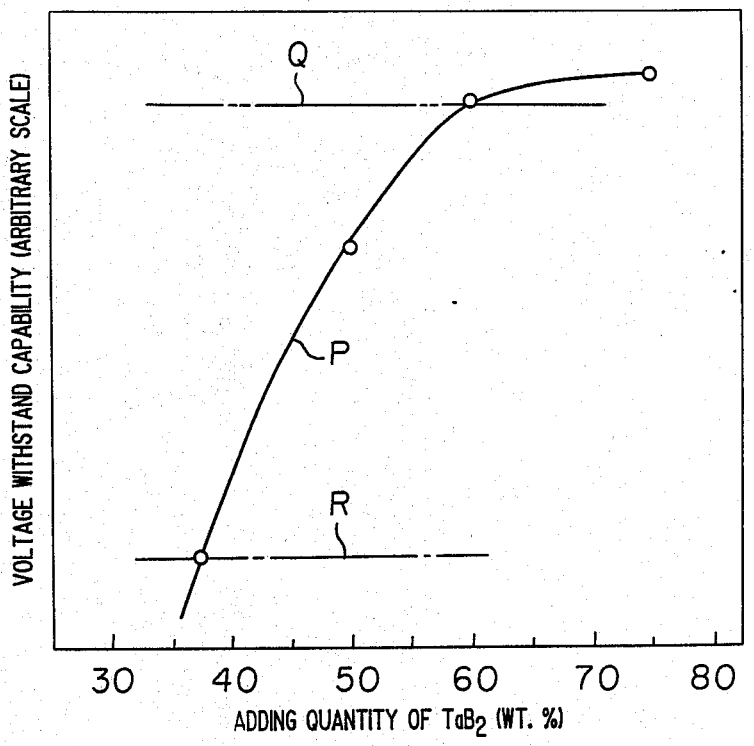
Figure 7:
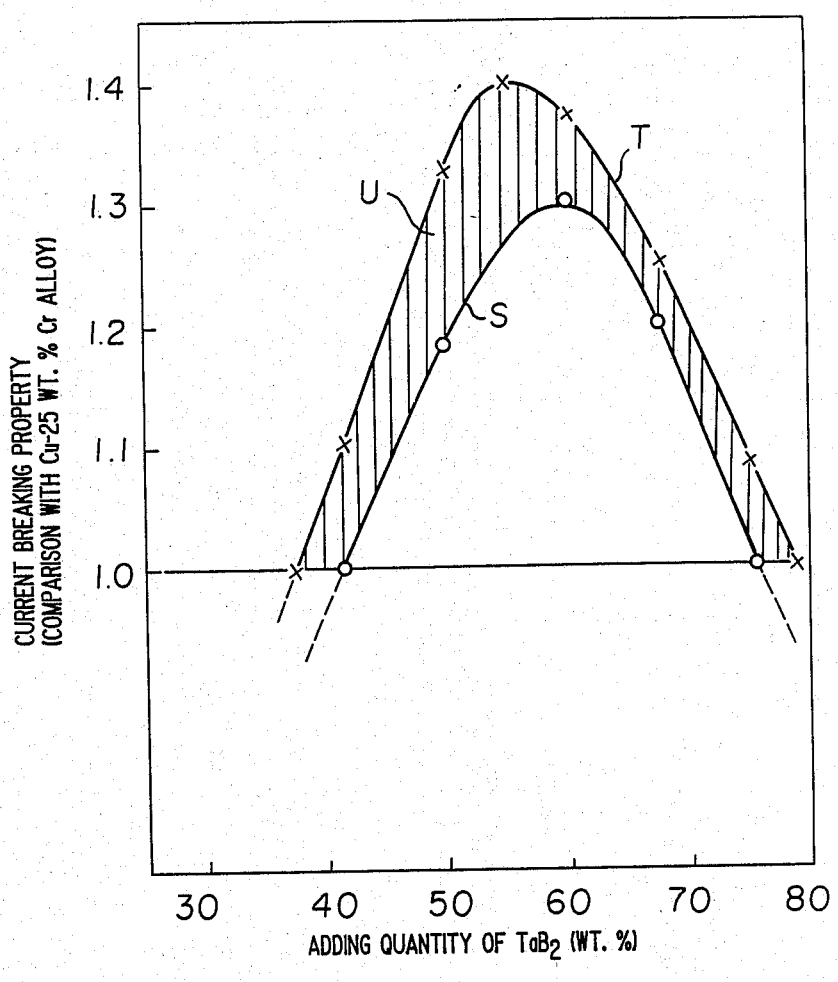

FIG. 6 is a graphical representation showing the relationship between the adding quantity of $TaB_2$ and the voltage withstand capability of the contact material according to the embodiment of the present invention, wherein the quantity of $TaB_2$ is varied; and FIG. 7 is a graphical representation showing the relationship between the adding quantity of $TaB_2$ and the current breaking capability of the contact material according to other embodiment of the present invention, wherein the quantity of Ti is varied.

DETAILED DESCRIPTION OF PREFERRED EMBODIMENTS

In the following, the present invention will be described in detail with reference to specific embodiments thereof. The contact material for the vacuum circuit breaker which consists essentially of copper and boride of tantalum, or of copper, chromium, and boride of tantalum possesses excellent current breaking property and voltage withstand capability owing to the function of boride of tantalum finely dispersed in the alloy, which contributes to reinforcement of the copper base to thereby suppress partial fusion phenomenon occuring on the surface of the contact and prevent generation of undesirable protrusions which cause decrease in the voltage withstand capability. Also, the contact material for the vacuum circuit breaker which consists essentially of copper, boride of tantalum, and titanium possesses its excellent current breaking property and voltage withstand capability owing to various other functions than the above-mentioned, such as, for example, cooling fo the arc which generates between the contacts by the interaction of the constituent elements, suppressing generation of the anodic point so as to contribute to promotion of dielectric recovery at the time of current breakage, and so forth.

The present inventors produced various alloy materials, on the experimental basis, by addition of various metals, alloys, and intermetallic compounds to copper base, and by assembly of such alloy materials in the vacuum circuit breaker for various tests. As the result of such tests, they found out that the contact materials composed of copper and boride of tantalum, or of copper chromium, and boride of tantalum possessed superior current breaking property and voltage withstand capability. Furthermore, they discovered that addition of titanium to the alloy of copper and boride of tantalum contributed to further increase in the current breaking property.

With a view to enabling those persons skilled in the art to put the present invention into practice, the following preferred examples of manufacturing the contact material and experiments on its properties are presented. It should, however, be noted that the present invention is not restricted to these examples alone.

EXAMPLE 1

(Production of Contact Material)

The contact material was produced in accordance with the powder metallurgy using the three methods of "atmospheric sintering", "hot pressing" and "infiltration".

Production of the contact material according to the first method of atmospheric sintering was carried out in such a manner that chromium powder having a particle size of 70 μm or below, $TaB_2$ powder having a particle size of 40 μm or below, and copper powder having a particle size of 40 μm or below were each weighed at a predetermined ratio, followed by mixing the ingredients for two hours; subsequently, this mixed powder was filled in a metal mold and subjected to shaping under pressure; thereafter, this press-formed body was sintered for two hours in the hydrogen atmosphere at a temperature immediately below the melting point of copper, thereby obtaining the intended contact material.

Production of the contact material according to the second method of hot-pressing was carried out in such a manner that chromium powder having a particle size of 70 μm or below, $TaB_2$ powder having a particle size of 40 μm or below, and copper powder having a particle size of 40 μm or below were weighed at a predetermined ratio, followed by mixing the ingredients for two hours; subsequently, this mixed powder was filled in a carbon die and then subjected to heating in the vacuum for two hours at a temperature immediately below the melting point of copper, during which a pressure of from 100 to 300 kg/cm$^2$, for example, 200 kg/cm$^2$ in this example, was applied to the mixed powder by means of the hot press device, thereby obtaining a mass of the contact material.

Production of the contact material according to the third method of infiltration was carried out in such a manner that chromium powder having a particle size of 70 μm or below, $TaB_2$ powder having a particle size of 40 μm or below, and copper powder having a particle size of 40 μm or below were each weighed at a predetermined ratio (by the way, the quantity of copper powder to be added here is small), followed by mixing the ingredients for two hours; subsequently, this mixed powder was filled in a metal mold of a predetermined configuration and subjected to shaping under pressure; thereafter, this shaped body was sintered in the vacuum for two hours at a temperature immediately below the melting point of copper to thereby obtain a virtual sintered body; and, after this, a mass of oxygen-free copper was placed on this virtual sintered body, which was held for one hour in the hydrogen atmosphere at a temperature above the melting point of copper to thereby obtain the contact material with the oxygen-free copper having been impregnated into the virtual sintered body. While it is possible to regulate copper in the contact material in a desired quantity by varying the shaping pressure to be applied to the mixed powder, it is preferable that the volume of copper in the contact material should be smaller by ½ or below than the whole contact material, in order for copper to be impregnated into the shaped body, after it was obtained, containing voids therein, which is the characteristic feature of this production method.

Figure 1:
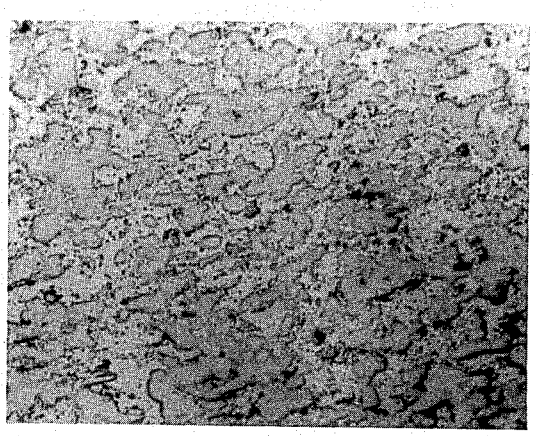
FIG. 1 is a micrograph in the scale of 100 magnification showing a microstructure of the alloy contact material composed of copper (Cu), 25% by weight of chromium (Cr), and 5% by weight of $TaB_2$ according to one embodiment of the present invention.

FIG. 1 of the accompanying drawing is a micrograph in the scale of 100 magnification showing a microstructure of the contact material composed of an alloy of Cu-Cr-$TaB_2$ according to one embodiment of the present invention. This Cu-Cr-$TaB_2$ alloy contact material was obtained by first weighing chromium powder, $TaB_2$ powder, and copper powder at their respective weight ratio of 25:5:70, and then subjecting the ingredients in mixture to the above-described first method of atmospheric sintering. Incidentally, the atmosphere used was high purity hydrogen atmosphere, and the sintering temperature was in a range of from 1,050° C. to 1,080° C. It will be seen from FIG. 1 that Cr and $TaB_2$ are uniformly and finely distributed in the copper base.

Figure 2:
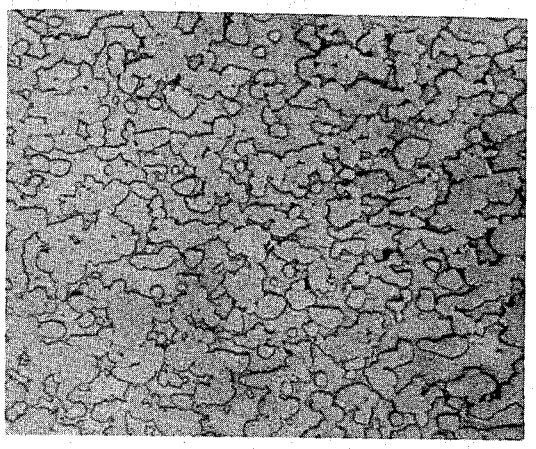
FIG. 2 is a micrograph in the scale of 100 magnification showing a microstructure of a conventional alloy contact material composed of copper (Cu) and 25% by weight of chromium (Cr).

FIG. 2 is a micrograph in the scale of 100 magnification showing a microstructure of a conventional Cu-25 wt. % Cr alloy contact material, for the sake of comparison. This Cu-Cr alloy contact material was obtained by first weighing chromium powder having a particle size of 70 μm or below and copper powder having a particle size of 40 μm or below at their respective weight ratio of 25:75, then subjecting the ingredients in mixture to the afore-described first method of atmospheric sintering. Incidentally, the atmosphere used was high purity hydrogen atmosphere, and the sintering temperature was in a range of from 1,050° C. to 1,080° C.

(Experiments on Properties of Contact Material)

The above-described contact materials produced in accordance with each of the afore-described various methods in the powder metallurgy were processed by machine into electrodes, each having 20 mm in diameter. After this, each of the electrodes was assembled into a vacuum circuit breaker to measure its electrical properties.

Figure 3:
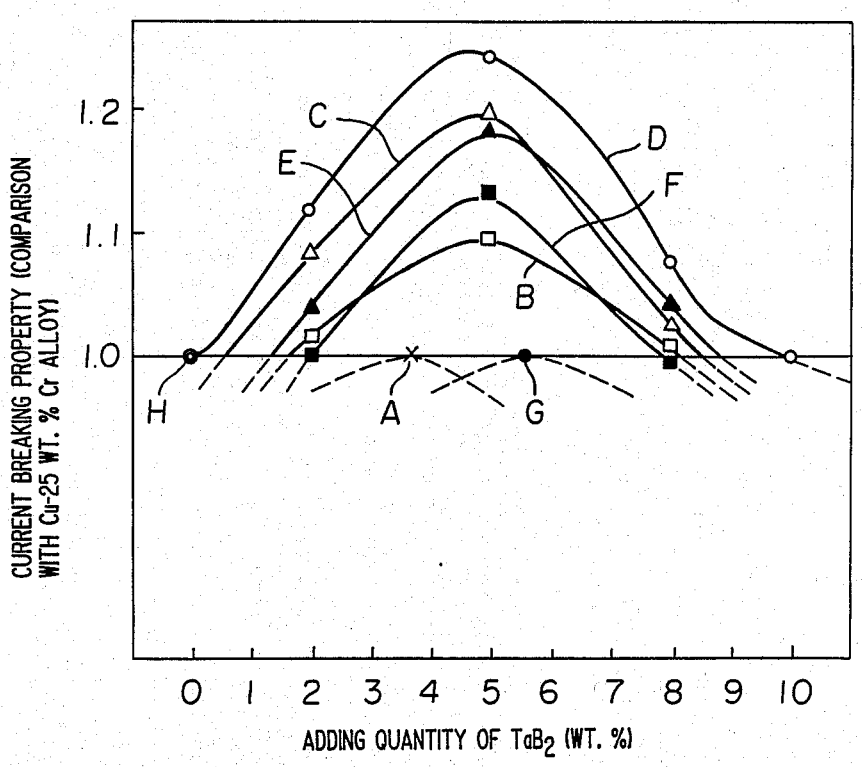
FIG. 3 is a graphical representation showing the relationship between the adding quantity of $TaB_2$ (% by weight) and the current breaking property of the contact material according to the embodiment of the present invention.

FIG. 3 indicates the current breaking property of the alloy contact material according to the embodiment of the present invention, in which the current breaking property of the contact material according to the embodiment of the present invention is expressed in terms of the current breaking property of the conventional Cu-25 wt. % Cr alloy contact material, when it is set at "l(H)". FIG. 3 indicates a relationship between the adding quantity of $TaB_2$ and the current breaking property, wherein the content of Cr in the alloy (wt. %) is fixed at 10(A), 15(B), 20(C), 25(D), 30(E), 35(F), and 40(G), respectively. As seen from FIG. 3, there is a region, in which the current breaking property surpasses that of the conventional contact point made up of Cu-25 wt. % Cr alloy, owing to addition of a small amount of $TaB_2$ with respect to each fixed quantity of chromium. It is therefore understood that such alloy is suitable as the contact material for the circuit breaker intended to be used for a large current circuit. However, depending on the quantity of chromium, there may be such a case that no improvement in the current breaking property can be attained even by addition of $TaB_2$. Within the extent of the tests conducted in this example, a very efficacious range of the chromium content is from 10 to 40% by weight, or particularly, a ratio of 25% by weight is the most excellent. Also, with regard to addition of $TaB_2$, there is an optimum range, 10% by weight or less of which produces a very effective result, and an alloy composed of 25 wt. % Cr and 5 wt. % $TaB_2$ is found to be the most excellent, to wit, the alloy exhibits its current breaking property 1.25 times as high as that of the conventional Cu-25 wt. % Cr alloy. Since, in the experiments according to this example, detailed measurements were conducted on those alloys having their current breaking property superior to that of the conventional alloy, the current breaking property of those alloys inferior to that of the conventional alloy cannot be indicated at a concrete ratio, hence such current breaking property is shown in the drawing by broken lines. It should also be noted that, in the graphical representation of FIG. 3, the current breaking property of the alloy according to the example of this invention and that of the conventional alloy are shown with values of such alloys as produced by the atmospheric sintering method, because there could hardly be seen a difference in the property between the atmospheric sintering method and the hot pressing method.

Figure 4:
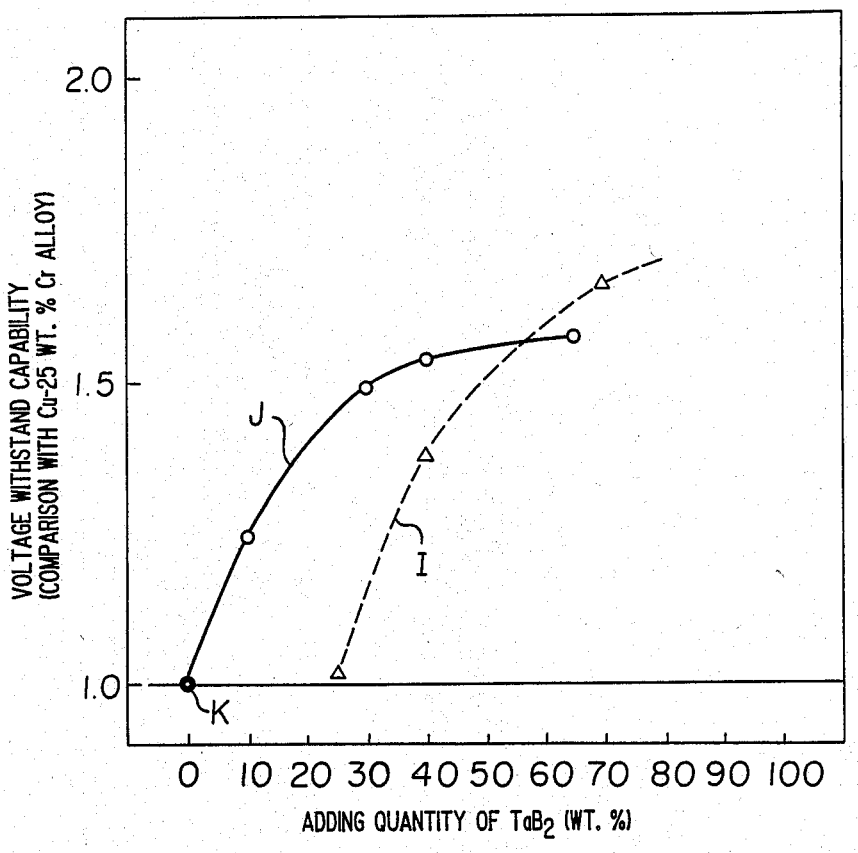
FIG. 4 is a graphical representation showing the relationship between the adding quantity of $TaB_2$ and the voltage withstand capability of the contact material according to the embodiment of the present invention.

FIG. 4 is a graphical representation showing a relationship between the adding quantity of $TaB_2$ and the voltage withstand capability, when the amount of chromium in the alloy (wt. %) is fixed at 10(I) and 25(J). The voltage withstand capability is indicated by a ratio, when the voltage withstand capability of the conventional Cu-25 wt. % Cr alloy (K) is set at "1". As seen from FIG. 4, a remarkable improvement in the voltage withstand capability is resulted from addition of $TaB_2$ with respect to each fixed quantity of chromium, hence the alloy according to this example of the present invention is found to be very excellent as the contact material for high voltage circuit breaker. Although the voltage withstand capability increases with increase in the adding quantity of $TaB_2$, the rate of increase becomes gentle as the adding quantity of $TaB_2$ increases, and no further increase is seen when the total amount of Cr and $TaB_2$ reaches 80% by weight or so. It was noted that, in some cases, when the amount exceeds 80% by weight, the voltage withstand capability of the alloy may sometimes lower, hence appropriate selection of the adding quantity of $TaB_2$ is essential depending on the purpose of its use. Although no detailed mechanism of improvement in the voltage withstand capability owing to the addition of TaB2 has yet to be clarified, it may be assumed that $TaB_2$ has its effects of finely dispersing in the alloy to contribute to reinforcement of the copper base and chromium particles, thereby suppressing partial fusion-bonding phenomenon on the surface of the contact as well as preventing occurrence of protrusions which brings about decrease in the voltage withstand capability, all these being considered to participate in remarkable improvement in the voltage withstand capability of the alloy. However, when the amount of Cr and $TaB_2$ increases more than necessary, it may happen that no uniform alloy free from defects can be obtained from the standpoint of its manufacturing. Also, from the fact that its machinability becomes poor, those factors such as occurrence of protrusions on the surface of the contact material being liable to lower the voltage withstand capability inversely increases. For these reasons, the voltage withstand capability stops increasing at a centain level for the adding quantity of $TaB_2$, when it is excessive. From the experimental results, the total amount of both Cr and $TaB_2$ in the alloy should preferably be 80% by weight or below. By the way, of the alloys shown in FIG. 4, the measured values of the voltage withstand capability of the alloys having the total amount of Cr and $TaB_2$ of 50% by weight or more are of those alloys produced by the infiltration method, while the measured values of that of the alloys having the total amount of Cr and $TaB_2$ of less than 50% by weight are of those alloys produced by the atmospheric sintering method.

In this example, explanations have been given as to the alloys, in which $TaB_2$ is used as the boride of tantalum, although similar effect could result from use of other borides of tantalum such as TaB, etc.

EXAMPLE 2

(Production of Contact Material)

The contact material was produced in accordance with the powder metallurgy using the three methods of "atmospheric sintering", "hot pressing", and "infiltration".

Production of the contact material according to the first method of atmospheric sintering was carried out in such a manner that $TaB_2$ powder having a particle size of 40 μum or below and copper powder having a particle size of 40 μm or below were each weighed at a ratio of 42:58, followed by mixing the ingredients for about two hours; subsequently, this mixed powder was filled in a metal mold having a diameter of 30 mm and subjected to shaping so as to attain 70% or more of the theoretical density; thereafter, this shaped body was sintered in the hydrogen atmosphere at a temperature immediately below the melting point of copper, thereby obtaining the intended contact material.

Production of the contact material according to the second method of hot-pressing was carried out in such a manner that $TaB_2$ powder having a particle size of 40 μm or below and copper powder of 40 μm or below were each weighed at a ratio of 50:50, followed by mixing the ingredients for about two hours; subsequently, this mixed powder was filled in a molding die made of carbon having an internal diameter of 30 mm and then subjected to heating in the vacuum at a temperature immediately below the melting point of copper, during which a pressure in a range of from 100 to 400 kg/cm$^2$ was applied to the mixed powder, thereby obtaining a mass of the contact material.

Production of the contact material according to the third method of infiltration was carried out in such a manner that $TaB_2$ powder having a particle size of 40 μm or below and copper powder having a particle size of 40 μm or below were each weighed at a ratio of 95:5, followed by mixing the ingredients for about two hours; subsequently, this mixed powder was pre-formed in a metal mold having a diameter of 30 mm so as to obtain a predetermined porosity; thereafter, this pre-formed body was subjected to reduction treatment in the hydrogen atmosphere at a temperature in a range of from 900° C. to 1,080° C. In this example, a pressure for the pre-forming was set in a range of from 0.2 to 6 ton/cm$^2$ to thereby obtain a skeleton having an arbitrary porosity of 60% or below by the volumetric ratio. Then, copper was impregnated into the voids in the pre-formed body corresponding to the above-mentioned porosity, through which an alloy of the final composition of Cu-60 wt. % $TaB_2$ having a density of 95% or above with respect to the theoretical density was obtained.

(Experiments on Properties of Contact Material)

Figure 5:
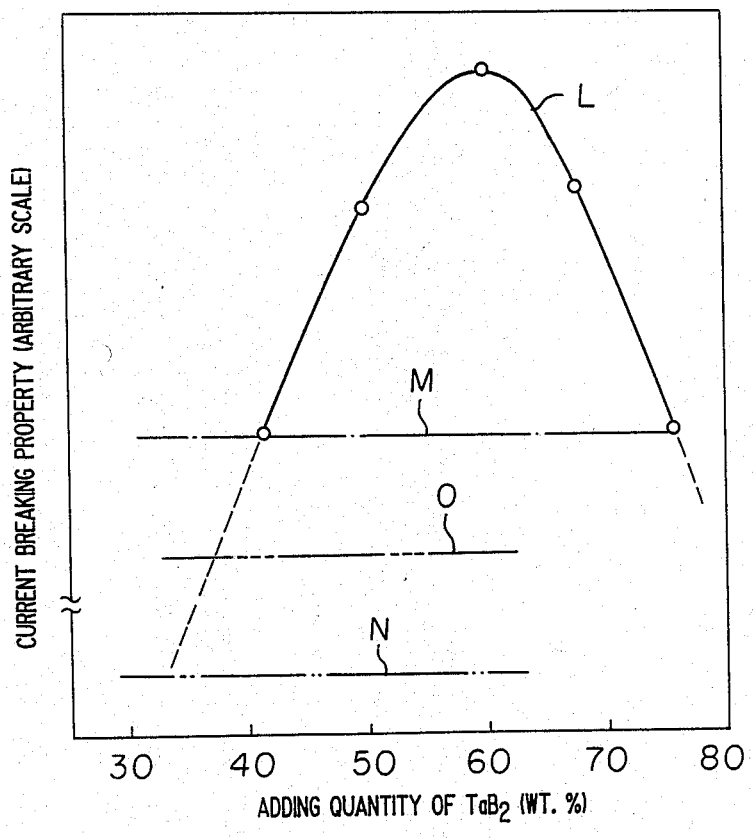
FIG. 5 is a graphical representation showing the relationship between the adding quantity of $TaB_2$ and the current breaking property of the contact material according to the embodiment of the present invention.

The contact materials in accordance with this example of the present invention as produced by each of the afore-described various methods in the powder metallurgy were processed by machine into electrodes, each having a diameter of 20 mm. After this, each of the electrodes was assembled into a vacuum circuit breaker to measure its electrical properties. FIG. 5 indicates the current breaking property of the alloy according to this example of the present invention, which is the variations (L) in the current breaking property owing to the addition of $TaB_2$ into the alloy. As seen from the curve (L) in FIG. 5, the current breaking property of the alloy is remarkably improved by the addition of $TaB_2$ to copper base. The current breaking property reached its peak with the content of $TaB_2$ of 60% by weight, and beyond that content ratio of $TaB_2$, the current breaking property of the alloy was prone to decrease. On the other hand, for the purpose of comparison, the current breaking property of the following three kinds of alloys are also shown in FIG. 5:

(a) Cu-70 wt. % W alloy (N) which has often been used heretofore for the high voltage withstand purpose;

(b) Cu-10 wt. % W alloy (O) which exhibits relatively satisfactory current breaking property out of various Cu-W alloys; and (C) Cu-25 wt. % Cr alloy (M) which is excellent in its current breaking property and has often been used for a large current circuit breakers. As is apparent from FIG. 5, the Cu-$TaB_2$ alloy has a more excellent current breaking property than the conventional Cu-W alloy over a wide range of the $TaB_2$ content, and the Cu-$TaB_2$ alloy with the $TaB_2$ content being in a range of from 41 to 75% by weight shows more excellent current breaking property than that of the conventional Cu-25 wt. % Cr alloy. By the way, the Cu-60 wt. % $TaB_2$ alloy had its current breaking property of approximately 1.3 times as high as that of the Cu-25 wt. % Cr alloy. Further, from the comparison between the Cu-$TaB_2$ alloy of the present invention and the conventional Cu-70 wt. % W alloy, it appears that the amount of $TaB_2$ with respect to copper is effective in the entire range of its content. Incidentally, of the alloys according to the example of the present invention as shown in FIG. 5, those alloys containing therein $TaB_2$ in an amount not reaching 60 wt. % (50% by volume) and the conventional Cu-25 wt. % Cr alloy and the Cr-10 wt. % W alloy are each shown by the values of the alloy contact materials manufactured by the first method of atmospheric sintering. On the other hand, the alloy containing therein 60% by weight or more of $TaB_2$ (50% by volume) and the conventional Cu-70 wt. % W is shown in the graphical representation with those values obtained by the third method of infiltration. Further, the current breaking property of the Cu-10 wt. % W alloy is approximately one half that of the Cu-25 wt. % Cr alloy.

FIG. 6 shows the voltage withstand capability of the alloy according the example of this invention, in which the variations in the voltage withstand capability depending on the adding quantity of $TaB_2$ in the alloy is shown by a curve (P). It will be seen from FIG. 6 that the voltage withstand capability improves remarkably with increase in the adding quantity of $TaB_2$. The rate of increase tends to be very high within a range of small adding quantity of $TaB_2$, but it tends to lower as the quantity of $TaB_2$ increases, although the alloy added with 60% by weight or more of $TaB_2$ the voltage withstand capability (Q) of the conventional high voltage withstand contact alloy of Cu-70 wt. % W. On the other hand, with the $TaB_2$ content of 37% by weight or more, the voltage withstand capability of the alloy according to the present invention is seen to surpass that of the conventional alloy of Cu-25 wt. % Cr (R).

From both FIGS. 5 and 6, it will be seen that the Cu-$TaB_2$ alloy according the example of this invention can find its use over the entire range of the $TaB_2$ content, provided that apt choice is made depending on use. For the large current and high tension contact material which is excellent in both current breaking property and voltage withstand capability, use of the alloy having the $TaB_2$ content of from 60 to 75% by weight is the most effective.

FIG. 7 shows the current breaking property of a contact material containing both $TaB_2$ and Ti in Cu, wherein the current breaking property of the contact material according to the example of this invention is indicated in terms of the current breaking property of the conventional alloy contact material, when it is expressed as "1". In the graphical representation of FIG. 7, the variations in the current breaking property owing to addition of $TaB_2$ are shown in terms of variations in the adding quantity of Ti. As seen from FIG. 7, there is a region, in which the current breaking property is much higher than the property shown by a curve (S) of the alloy consisting of Cu and $TaB_2$ alone, depending on the adding quantity of Ti. In particular, a small adding quantity of Ti of 7% by weight or less is very effective (shaded portion U), accompanied by further effect of the $TaB_2$ content expanding to a range of from 37 to 78% by weight, which exceeds that of the conventional alloy of Cu-25 wt. % Cr. Also, the most satisfactory effect can be resulted even with the Ti content of 3% by weight (curve T). Incidentally, it should be noted that the Ti content should preferably be within a range of 7% by weight or below depending on the purpose of use, because a large adding quantity of Ti tends to increase specific resistance of the alloy.

On the other hand, the above-mentioned alloy of the present invention is highly excellent in comparison with the conventional alloy of Cu-25 wt. % Cr alloy in respect of its voltage withstand capability. In particular, those alloys with high content of $TaB_2$ and Ti exhibit the excellent voltage withstand capability.

By the way, in this second example of the present invention, explanations have been given as to the alloys, in which $TaB_2$ is used as the boride of tantalum. It should, however, be noted that the same effect can be obtained with use of other borides of tantalum such as TaB etc.

As has been explained in the foregoing, the present invention makes it possible to provide the contact material for the vacuum circuit breaker excellent in its current breaking property and the voltage withstand capability by use of an alloy composed of copper and boride of tantalum, or an alloy composed of copper, chromium and boride of tantalum. Furthermore, the present invention can also provide the contact material for the vacuum circuit breaker excellent in its current breaking property by use of an alloy composed of copper, boride of tantalum and titanium.

Although the present invention has been described with reference to specific examples thereof, it should be note that these examples are illustrative only and not so restrictive, and that various changes and modifications in the constituent elements and their content may be made by those persons skilled in the art within the ambit of the present invention as set forth in the appended claims.

What is claimed is:

1. A contact material for a vacuum circuit breaker which consists essentially of copper, chromium, and a boride of tantalum, wherein the content of said boride of tantalum is 10% by weight or less.

2. A contact material for a vacuum circuit breaker according to claim 1, wherein the total content of chromium and boride of tantalum is 80% by weight or less.

3. A contact material for a vacuum circuit breaker according to claim 1, wherein the content of chromium is in a range of from 10 to 40% by weight.

4. A contact material for a vacuum circuit breaker according to claim 1, wherein boride of tantalum is at least one kind selected from the group consisting of $TaB_2$ and TaB.

* * * * *